US006244234B1

(12) United States Patent
Hoeg

(10) Patent No.: US 6,244,234 B1
(45) Date of Patent: Jun. 12, 2001

(54) EXHAUST VALVE FOR AN INTERNAL COMBUSTION ENGINE

(75) Inventor: Harro Andreas Hoeg, Allerød (DK)

(73) Assignee: Man B&W Diesel A/S, Copenhagen SV (DK)

( * ) Notice: Subject to any disclaimer, the term of this patent is extended or adjusted under 35 U.S.C. 154(b) by 0 days.

(21) Appl. No.: 09/194,783

(22) PCT Filed: Jun. 3, 1997

(86) PCT No.: PCT/DK97/00245

§ 371 Date: Dec. 3, 1998

§ 102(e) Date: Dec. 3, 1998

(87) PCT Pub. No.: WO97/47861

PCT Pub. Date: Dec. 18, 1997

(30) Foreign Application Priority Data

Jun. 7, 1996 (DK) ..... 0641/96

(51) Int. Cl.[7] ..... F01L 3/02

(52) U.S. Cl. ..... 123/188.3; 123/188.11; 123/188.2; 123/188.8

(58) Field of Search ..... 123/188.3, 188.8, 123/188.2, 188.11

(56) References Cited

U.S. PATENT DOCUMENTS 4,741,080 * 5/1988 Larson et al. ..... 29/156.7 R
4,844,864 * 7/1989 Frank ..... 420/447
5,131,961 * 7/1992 Sato et al. ..... 148/677

FOREIGN PATENT DOCUMENTS 0 280 467 2/1988 (EP) .
0 384 013 11/1989 (EP) .
0 521 821 A2 6/1992 (EP) .
0 602 904 A1 12/1993 (EP) .
60-070155 4/1985 (JP) .
8/61028 8/1994 (JP) .

* cited by examiner

*Primary Examiner*—Tony M. Argenbright
*Assistant Examiner*—Katrina B. Harris
(74) *Attorney, Agent, or Firm*—Sughrue, Mion, Zinn, Macpeak & Seas, PLLC

(57) ABSTRACT

An exhaust valve for an internal combustion engine including a movable spindle with a valve disc of a nickel-based alloy which also constitutes an annular seat area at the upper surface of the valve disc. The seat area abuts a corresponding seat area on a stationary valve member in the closed position of the valve. At manufacturing, the seat area of the valve disc is subjected to a thermo-mechanical deformation process at a temperature lower than or around the recrystallization temperature of the alloy. The seat area on the upper surface of the valve disc has been given dent mark preventing properties in the form of a yield strength of at least 1000 MPa at a temperature of approximately 20° C. by means of the thermo-mechanical deformation process and possibly a yield strength increasing heat treatment.

20 Claims, 2 Drawing Sheets

EXHAUST VALVE FOR AN INTERNAL COMBUSTION ENGINE

1. CROSS REFERENCE TO RELATED APPLICATIONS

Figure 1:
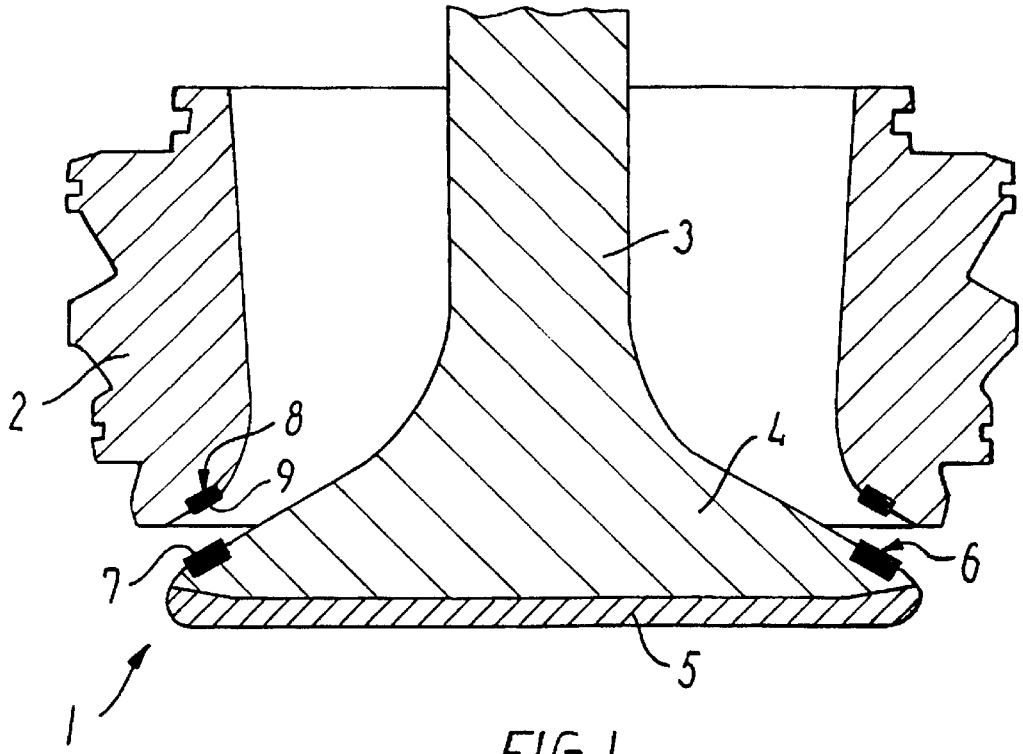

This application claims the benefit of priority from Danish patent application No. 641/96 filed Jun. 7, 1996 and from International patent Application No. PCT/DK97/00245 filed Jun. 3, 1997.

2. BACKGROUND OF INVENTION a. Field of Invention

The present invention relates to an exhaust valve for an internal combustion engine. In particular it relates to a two-stroke crosshead engine, comprising a movable spindle with a valve disc of a nickel-based alloy which also constitutes an annular seat area at the upper surface of the valve disc, which seat area abuts a corresponding seat area on a stationary valve member in the closed position of the valve. The seat area of the valve disc has been subjected at its manufacture to a thermo-mechanical deformation process at which the material is at least partially cold-worked.

b. Description of Related Art

The development of exhaust valves for internal combustion engines has aimed for many years at extending the life and reliability of the valves. This has been done so far by manufacturing the valve spindles with a hot-corrosion-resistant material on the lower disc surface and a hard material in the seat area.

The seat area is particularly crucial for the reliability of the exhaust valve, as the valve has to close tightly to function correctly. It is well-known that the ability of the seat area to close tightly can be reduced by corrosion in a local area by a so-called burn through, where across the annular sealing surface a channel-shaped gutter emerges, through which hot gas flows when the valve is closed. Under unfortunate circumstances, this failure condition can arise and develop into a rejectable valve during less than 80 hours' operation, which means that often it is not possible to discover the beginning failure at the usual overhaul. Therefore, a burn through in the valve seat may cause unplanned shut-downs. If the engine is a propulsion engine in a ship, the failure may arise during a single voyage between two ports, which may cause problems during the voyage and unintended expensive waiting time in port.

With a view to preventing burn throughs in the valve seat many different valve seat materials with ever increasing hardness have been developed over the years to make the seat wear-resistant by means of the hardness and reduce the formation of dent marks. The dent marks are a condition for development of a burn through as the dents may create a small leak through which hot gas flows. The hot gas can heat the material around the leak to a level of temperature where the gas with the aggressive components has a corrosive effect on the seat material so that the leak rapidly grows larger and the leakage flow of hot gas increases, which escalates the erosion. In addition to the hardness, seat materials have also developed towards a higher hot corrosion resistance to delay erosion after the occurrence of a small leak.

An exhaust valve of the above type and manufactured from the material NIMONIC 80A is described in the article 'Herstellung von Ventilspindeln aus einer Nickelbasislegierung für Schiffsdieselmotoren', Berg- und Hüttenmännische Monatshefte, volume 130, September 1985, No. 9.

The thermo-mechanical forging is controlled so that a high hardness is achieved in the seat area. In consideration of the mechanical properties of the exhaust valve, such as fatigue resistance, etc., the article prescribes that the NIMONIC 80A valve has a yield strength of at least 800 MPa.

EP-A-0 280 467 describes an exhaust valve made of NIMONIC 80A manufactured from a base body forged into the desired shape after solution annealing. The seat area is thus cold-worked for provision of high hardness. Subsequently the valve can be precipitation-hardened.

The book 'Diesel engine combustion chamber materials for heavy fuel operation' published in 1990 by The Institute of Marine Engineers, London, collects the experience gained for exhaust valve materials in a number of articles and provides recommendations as to how to design valves to achieve long life. Concerning valve seats the articles unanimously direct that the seat material has to have a high hardness and be of a material with a high resistance against hot corrosion. A number of different preferred materials for exhaust valves are described in Paper 7 of the book 'The physical and mechanical properties of valve alloys and their use in component evaluation analyses', including in its analysis of the mechanical properties of the materials a comparative table of the yield strength of the materials, seen to be below about 820 MPa.

3. BRIEF SUMMARY OF INVENTION

It is desirable to prolong the life of the exhaust valve and particularly to reduce or avoid unpredictable and rapid development of burn throughs in the seat area of the valve. The Applicant has carried out tests with dent mark formation in seat materials and contrary to the established knowledge has established quite unexpectedly that the hardness of the seat material does not have any great influence on whether the dent marks emerge.

The object of the present invention is to provide seat materials that anticipate the mechanism leading to formation of dent marks, whereby the basic condition for occurrence of burn throughs is weakened or eliminated.

In view of this the exhaust valve according to the invention is characterized in that the valve disk is made of a nickel-based alloy which can achieve a yield strength of at least 1000 MPa, and that the seat area at the upper surface of the valve disc has been given dent mark preventing properties in the form of a yield strength ($R_{p0.2}$) of at least 1000 MPa at a temperature of approximately 20° C. by means of the thermo-mechanical deformation process and possibly a yield strength increasing heat treatment.

Dent marks are formed by particulate combustion residues, such as coke particles, which flow from the combustion chamber up through the valve and into the exhaust system while the exhaust valve is open. When the valve closes, the particles may get caught between the closing sealing surfaces on the valve seats.

From studies of numerous dent marks on valve spindles in operation it has been observed that new dent marks very rarely reach the upper closing rim, viz., the circumferential line at which the upper end of the stationary valve seat is brought into contact with the movable conical valve seat. In practice, the dents end about 0.5 mm away from the closing rim, which is without any immediate explanation, as a particle can also be expected to be caught in this area.

It has now been realized that the absence of dents immediately up to the closing rim is due to the fact that coke particles and other, even very hard particles are crushed to powder before the valve is completely closed. Part of the powder is blown away simultaneously with the crushing of the particles because the gas from the combustion chamber flows out through the gap between the closing sealing surfaces at approximately sonic velocity. The high gas velocity blows the powder near the closing rim away, and the absence of dents out to the rim shows that just about all particles getting caught between the sealing surfaces are pulverized. Even very thick particles are reduced in thickness by the crushing and blowing away of powder, and in practice the subsided piles of powder capable of forming the dent marks therefore have a highest thickness of 0.5 mm and a normal maximum thickness of 0.3–0.4 mm.

Especially within the most recent engine development where the maximum pressure may be 195 bar, the load on the lower surface of the disc may correspond to up to 400 tons. When the exhaust valve is closed and the pressure in the combustion chamber rises to the maximum pressure, the sealing surfaces are pressed completely together around an enclosed powder pile. This cannot be prevented, no matter how hard the seats are made.

When combustion of the fuel commences and the pressure in the cylinder and thus the load on the valve disc increase, the enclosed powder pile starts wandering into the two sealing surfaces and at the same time the seat materials are elastically deformed. During this elastic deformation the surface pressure between the powder pile and the sealing surfaces rises, which usually makes the powder pile deform into a larger area. If the powder pile is sufficiently thick, the elastic deformation continues until the pressure in the contact area of the powder pile reaches the yield strength of the seat material of the lowest yield strength, whereupon this seat material is plastically deformed and formation of the dent mark commences. The plastic deformation may result in an increase of the yield strength owing to deformation hardening. If the two seat materials in the local area around the powder pile thus achieve uniform yield strengths, the powder pile starts plastically deforming the other seat material as well.

If the formation of dent marks is to be countered, this, as mentioned above, cannot be done by making seat materials harder, instead they have to be made resilient, which is obtained by manufacturing the seat areas with a high yield strength. The higher yield strength provides a double effect. Firstly, the seat material with the higher yield strength may be exposed to a higher elastic strain and thus absorb a thicker powder pile before plastic deformation occurs.

The second essential effect is associated with the surface nature of the sealing surfaces in the areas facing the powder pile. The dent profile formed by the elastic deformation is even and smooth and promotes the distribution of the powder pile to a larger diameter, which partly reduces the thickness of the powder pile, partly reduces stresses in the contact area following from the greater contact area. At the transition from elastic deformation to plastic deformation a deeper and more irregular dent profile is rapidly created which will unsuitably anchor the powder pile and thus have a preventive effect on a further advantageous enlargement of the diameter of the pile.

Tests have shown that in an exhaust valve a powder pile of a thickness of about 0.14 mm can be absorbed between two seat areas of materials with a lower limit for the yield strength of 1000 MPa without any plastic deformation of the sealing surfaces. A large proportion of the particles caught between the seat surfaces will be crushed to a thickness of about 0.15 mm. The exhaust valve according to the invention prevents a noticeable proportion of the particles from forming dent marks because the seat surface merely springs back to its original shape when the valve opens, and at the same time the remains of the crushed particle are blown away from the seat surfaces.

In consideration of an increase of the elastic properties of the seat area, it is preferred that the seat area material has a yield strength of at least 1100 MPa, preferably at least 1200 MPa. Young's modulus for the current seat material is substantially unchanged at increasing yield strengths, which gives an approximately linear correlation between yield strength and the highest elastic strain. It appears from the above comments that a seat material with a yield strength of 2500 MPa or more would be ideal because it could absorb the powder piles of the normally most frequently occurring pile thickness purely by elastic deformation. However, at present suitable materials with such a high yield strength are not at hand. It will appear from the below description that some of the seat materials available today can be manufactured in a manner that raises the yield strength to at least 1100 MPa. All other things being equal, this 10% increase in yield strength will result in at least a 10% reduction of the depth of any dent marks. For most types of particles, the suitable limit of 1200 MPa is sufficiently high to provide a noticeable reduction of the pile thickness and consequently may result in a reduction of the dent mark depths of up to 30%, but at the same time the number of possible materials is narrowed down. This also applies to seat materials with a yield strength of at least 1300 MPa.

In an especially preferred embodiment the seat area material has a yield strength of at least 1400 MPa. This yield strength is almost double the yield strength of the seat materials used at present, and based on the present understanding of the mechanism of dent mark formation the material with this high yield strength is presumed to largely eliminate problems with seat area burn throughs. The depth of the few dent marks that can be formed in this seat material will be too small for leakage gas to flow through the dent mark in sufficiently large quantities for the seat material to be heated to a temperature where hot corrosion becomes effective.

In one embodiment the seat areas on the stationary member and the valve disc, respectively, have substantially the same yield strength at the operating temperatures of the seat areas. The largely uniform yield strengths of the two seat materials result in approximately the same manner of deformation of both sealing surfaces when the powder pile is pressed into the surfaces, which reduces the resulting plastic deformation in each of the surfaces. The stationary seat area is colder than the seat area on the spindle, which means that the spindle seat material should have the higher yield strength at about 20° C. in view of the fact that the yield strength for many materials drops at increasing temperatures. This embodiment is especially advantageous if the stationary seat area is made of a hot-corrosion-resistant material.

If the stationary seat area is of hardened steel or cast iron, the seat area on the stationary member preferably has a substantially higher yield strength than the seat area on the valve disc at the operating temperatures of the seat areas. With this design any dent marks will be formed on the valve spindle. This provides two advantages. Firstly the seat area on the spindle is normally made of a hot-corrosion-resistant material so that any dent mark will find it more difficult to develop into a burn through than if the dent was located on the stationary member. Secondly the spindle rotates so that at each valve closure the dent will be located at a new position on the stationary sealing surface, the heat influence thus being distributed on the stationary seat area.

The following materials are applicable according to the invention as valve disc and seat materials. It should be noted that NIMONIC is a proprietary trademark of INCO Alloys.

Preferably the whole body or at least the whole valve disc is made of a NIMONIC alloy. Of these it is well-known to use NIMONIC 80, NIMONIC 80A or NIMONIC 81, which have provided good operational experiences as regards wearing qualities and corrosion resistance in the corrosive environment present in the combustion chamber of a large diesel engine. Also applicable is NIMONIC Alloy 105 which after casting and conventional forging of the base body has a yield strength of about 800 MPa which has been brought to more than 1000 MPa after approximately 15% cold-working. Also NIMONIC PK50 is applicable and can be cold-worked and precipitation-hardened to a yield strength of approximately 1100 MPa. With the conventional NIMONIC alloys and a degree of deformation of 70% in the seat area it is possible to achieve a yield strength of approximately 1400 MPa. It is also possible to increase the yield strength further through a precipitation-hardening heat treatment.

The choice of manufacturing process can be influenced by the size of the exhaust valve, as a cold-working of many per cent may require strong tools when the valve disc is large, for example, with an external diameter ranging from 130 mm to 500 mm.

The present invention also relates to the use of a nickel-based chromium-containing alloy with a yield strength of at least 1000 MPa at approximately 20° C. as a dent mark limiting or preventive material in an annular seat area at the upper surface of a movable valve disc in an exhaust valve for an internal combustion engine, particularly a two-stroke crosshead engine, the seat area abutting a corresponding seat area on a stationary valve member when the valve is closed. The special advantages of using such a dent mark limiting material appear from the above description.

4. BRIEF DESCRIPTION OF THE DRAWINGS

Figure 2:
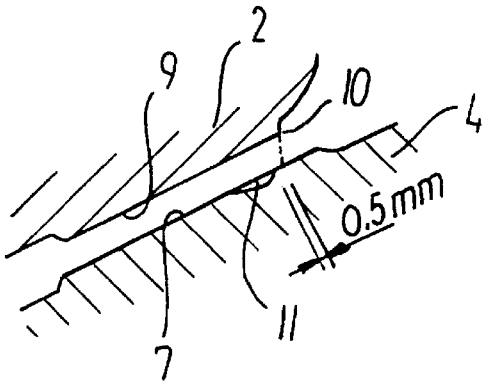
Figure 5:
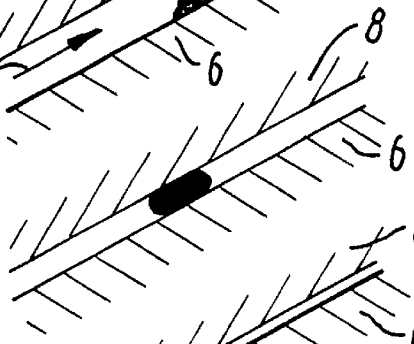
Figure 6:
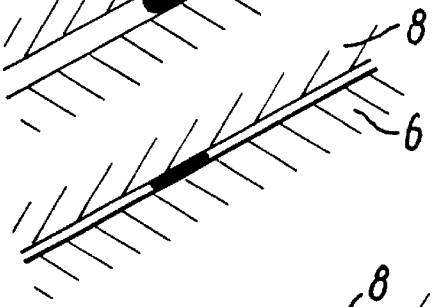
Figure 7:
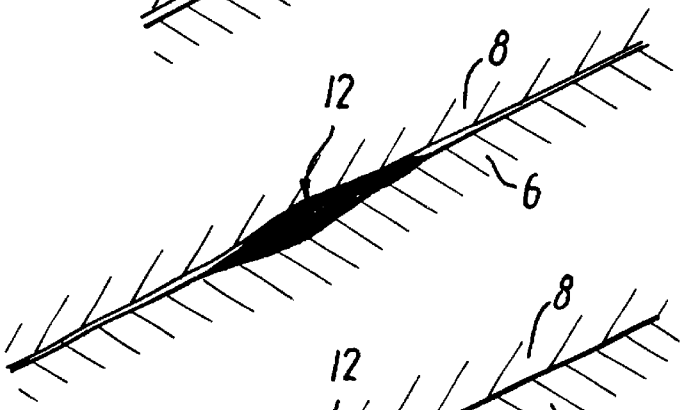
Figure 8:
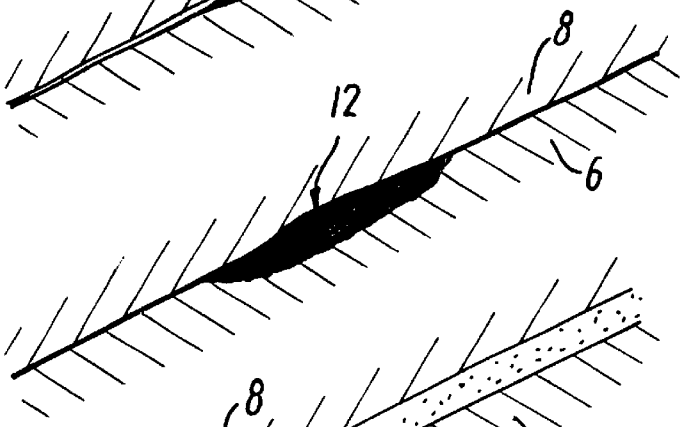
Figure 9:
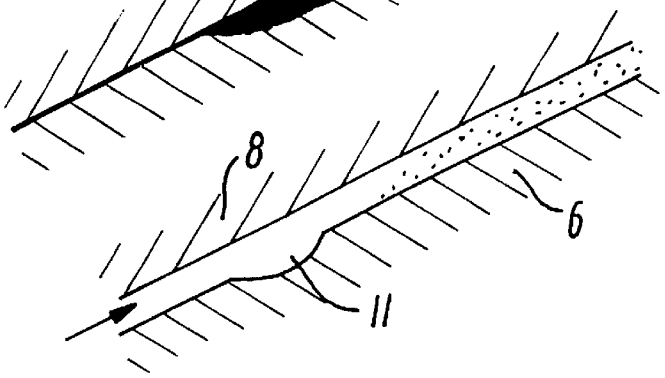

Examples of embodiments of the invention will now be described below in further detail with reference to the highly schematic drawing, in which FIG. 1 is a longitudinal sectional view through an exhaust valve according to the invention, FIG. 2 is a segmental view of the two seat areas with a typical dent mark sketched in, FIGS. 3–6 are segmental views of the two seat areas illustrating the particle crushing and the introductory steps in the dent mark formation, FIGS. 7 and 8 are enlarged segmental views of the dent mark formation, and FIG. 9 is a corresponding view of the surfaces immediately after reopening of the valve.

5. DETAILED DESCRIPTION OF THE PREFERRED EMBODIMENTS

FIG. 1 illustrates an exhaust valve generally designated 1 for a large two-stroke internal combustion engine, which may have cylinder diameters ranging from 250 to 1000 mm. The stationary valve member 2 of the exhaust valve, also called the bottom piece, is mounted in a cylinder cover, not shown. The exhaust valve has a movable spindle 3 supporting at its lower end a valve disc 4 and, in a well-known manner, being connected at its upper end with a hydraulic actuator for opening of the valve and a pneumatic return spring returning the spindle to its closed position. FIG. 1 shows the valve in a partially open position.

If a higher corrosion resistance than achievable with the base material is desired, the lower surface of the valve disc may be provided with a layer of hot-corrosion-resistant material 5. An annular seat area 6 on the upper surface of the valve disc is at a distance from the outer rim of the disc and has a conical sealing surface 7. Although the seat area in the Figure has a different numerical designation than the disc, it should be understood that both parts are made of the same alloy. The valve disc for the large two-stroke crosshead engine can have an external diameter in the interval from 120 to 500 mm depending on the cylinder bore.

The stationary valve member is also provided with a slightly projecting seat area 8 forming an annular conical sealing surface 9 which abuts the sealing surface 7 in the closed position of the valve. As the valve disc changes shape during heating to the operating temperature, the seat area is designed so that the two sealing surfaces are parallel at the operating temperature of the valve, which means that on a cold valve disc the sealing surface 7 only abuts the sealing surface 9 at the latter's upper rim 10 located farthest away from the combustion chamber.

FIG. 2 illustrates a typical dent mark 11 ending approximately 0.5 mm away from the closing rim on the sealing surface 7, viz., the circular arc where the upper rim 10 hits the sealing surface 7 as indicated by the vertical dotted line.

Figure 3:
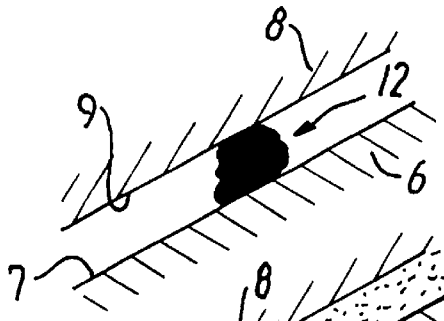
Figure 4:
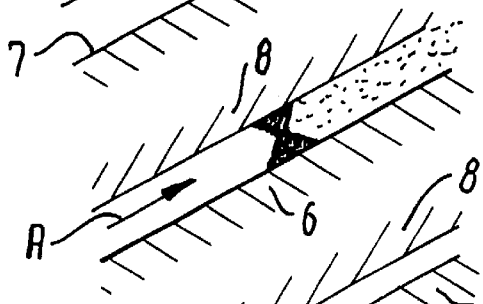

FIG. 3 illustrates a hard particle 12 which is caught between the two sealing surfaces 7, 9 immediately before the valve closes completely. At the continued closing motion, the particle is crushed into powder, of which a considerable part is entrained by the gas flowing up between the seats at sonic velocity as shown by the arrow A in FIG. 4. Part of the powder from the crushed particle will be locked between the sealing surfaces 7, 9 because the particles nearest the surfaces are retained by frictional forces, and the particles in the inter-space are locked by shear forces in the powder. Thus, opposite conical powder piles are formed facing tip to tip. The assumption prevailing so far to the effect that a solid particle is caught between the seat surfaces is thus not correct. Instead a reduction of the amount of material caught between the seats occurs because part of the powder blows away.

During the continued closing motion, the conical powder accumulations collapse and are spread in the plane of the surfaces to a lens-shaped powder body or a powder pile, as illustrated in FIG. 5. This lens-shaped powder body has proved to have a maximum thickness of 0.5 mm and a normal thickness for the largest accumulations of between 0.3 and 0.4 mm.

FIG. 6 illustrates the situation when the valve is closed, but before the pressure in the combustion chamber rises as a consequence of the combustion of the fuel. The pneumatic return spring is not in itself strong enough to pull the sealing surface 7 completely tight against the sealing surface 9 in the area around the powder body.

When the pressure in the combustion chamber rises after ignition of the fuel, the upward force on the lower disc surface rises strongly, and the sealing surfaces are pressed closer against each other. At the same time the powder body starts deforming the sealing surfaces elastically. If the powder body is sufficiently thick and the yield strength of the material is not sufficiently high, the elastic deformation will turn into plastic deformation making the dent permanent.

FIG. 7 illustrates a situation where the stationary seat area 8 has the highest yield strength, and where the seat area 6 on the disc is deformed elastically to just below its yield limit. At the continued compression to the completely compressed position of the sealing surfaces, as shown in FIG. 8, the powder body sinks into the sealing surface, the seat material being plastically deformed.

When the valve reopens, the particles are blown away by the outflow of gas, as shown in FIG. 9, and at the same time the seat materials spring back to their unloaded condition. To the extent a plastic deformation has occurred of one or both seat surfaces, a permanent dent mark 11 will be present in the sealing surface with a smaller depth than the largest indentation made by the powder body. The higher the yield strength of the seat material, the smaller the dent mark.

Examples of analyses for suitable materials will now be described. All amounts are stated in per cent by weight, and inevitable impurities are disregarded. It should also be mentioned that indications of yield strengths in the present description mean yield strengths at a temperature of approximately 20° C., unless another temperature is indicated. The alloys are chromium-containing nickel base alloys (or nickel-containing chromium base alloys). They have the property that there is no proper correlation between the hardness of the alloy and its yield strength, but on the contrary probably a correlation between hardness and tensile strength. In connection with these alloys, the yield strength means the strength generated by a strain of 0.2 ($R_{p0.2}$).

The alloy NIMONIC Alloy 105 has a nominal composition of 15% Cr, 20% Co, 5% Mo, 4.7% Al, up to 1% Fe, 1.2% Ti and a balance of Ni.

The alloy NIMONIC 80A comprises up to 0.1% C, up to 1% Si, up to 0.2% Cu, up to 3% Fe, up to 1% Mn, 18–21% Cr, 1.8–2.7% Ti, 1.0–1.8% Al, up to 2% Co, up to 0.3% Mo, up to 0.1% Zr, up to 0.008% B, up to 0.015% S and a balance of Ni.

The alloy NIMONIC 80 nominally comprises 0.04% C, 0.47% Si, 21% Cr, 0.56% Mn, 2.45% Ti, 0.63% Al and a balance of Ni.

The alloy NIMONIC 81 comprises up to 0.1% C, 29–31% Cr, up to 0.5% Si, up to 0.2% Cu, up to 1% Fe, up to 0.5% Mn, 1.5–2% Ti, up to 2% Co, up to 0.3% Mo, 0.7–1.5% Al and a balance of Ni.

The alloy NIMONIC PK50 nominally comprises 0.03% C, 19.5% Cr, 3% Ti, 1.4% Al, up to 2% Fe, 13–15.5% Co, 4.2% Mo and a balance of Ni.

The alloy Rene 220 comprises 10–25% Cr, 5–25% Co, up to 10% Mo+W, up to 11% Nb, up to 4% Ti, up to 3% Al, up to 0.3% C, 2–23% Ta, up to 1% Si, up to 0.015% S, up to 5% Fe, up to 3% Mn and a balance of Ni. Nominally, Rene 220 contains 0.02% C, 18% Cr, 3% Mo, 5% Nb, 1% Ti, 0.5% Al, 3% Ta and a balance of nickel. Deformation combined with precipitation hardening can achieve an extremely high yield strength in this material. At a degree of deformation of 50% at 955° C., the yield strength becomes approximately 1320 MPa; at a degree of deformation of 50% at 970° C., the yield strength becomes approximately 1400 MPa; at a degree of deformation of 50% at 990° C., the yield strength becomes approximately 1465 MPa, and at a degree of deformation of 25% at 970° C., the yield strength becomes approximately 1430 MPa. Precipitation hardening has been applied for 8 hours at 760° C. followed by 24 hours at 730° C. and 24 hours at 690° C.

Concerning the nominal analyses stated above it is obvious that in practice, depending on the alloy actually produced, deviations may naturally occur from the nominal analysis, just as inevitable impurities may also occur for all analyses.

Technical literature describes in detail how to heat treat the various alloys to generate precipitation hardening, and the heat treatment for solution annealing and the recrystallisation temperatures of the alloys are also well-known.

The thermo-mechanical deformation process for increasing the yield strength involves a hot/cold-working of the material by well-known methods, for example, by means of rolling or forging of the seat area or otherwise, such as beating or hammering thereof. After deformation the sealing surface of the seat can be ground in.

To reduce the forces required at the thermo-mechanical deformation process the body with the seat area can before deformation be exposed to solution annealing, for example for 0.1–2 hours at a temperature normally ranging between 1000 and 1200° C., depending on the analysis of the material, followed by quenching either in a salt bath to an intermediate temperature (typically 500° C.) followed by air cooling to room temperature or quenching in gases to room temperature. A hot/cold-working can then be carried out after these steps. To keep the forces suitably low the deformation preferably takes place at a raised temperature of about 900–1000° C., viz., below or around the lower limit for the recrystallisation temperature, which is typically approximately 950–1050° C. In this case with hot-working, a cooling from the solution annealing to approximately the recrystallisation temperature can advantageously be carried out without first cooling to room temperature. Possibly the deformation can be carried out in several steps with intermediate reheating. At a cold-working of approximately 20% it is typically possible to achieve a yield strength of 1200 MPa. If an especially high yield strength is desired, after completed deformation and working the seat area can be exposed to precipitation hardening which may, for example, take place for 24 hours at a temperature of 850° C. followed by 16 hours at a temperature of 700° C.

The base body treated as described above can be manufactured by means of casting and conventional forging or alternatively by means of a powder metallurgical compacting process, such as a HIP process or a CIP process in combination with hot extrusion or a similar deformation process.

The shaft of the valve may be of a material different from that of the disc and in that case can be friction-welded on to the disc.

What is claimed is:

1. An exhaust valve for an internal combustion engine having a stationary valve member with a seat area, wherein the exhaust valve comprises a movable spindle with a valve disc having an upper surface with an annular seat area, said valve disk and seat area being of a nickel-based alloy, and wherein said seat area of said nickel-based alloy has been given dent mark preventing properties in the form of a yield strength ($R_{p0.2}$) of at least 1000 MPa at room temperature by means of at least a thermo-mechanical deformation process involving coldworking.

2. An exhaust valve according to claim 1, wherein said cold-working of the material has taken place at a temperature lower than the recrystallisation temperature of the alloy.

3. An exhaust valve according to claim 1, wherein said cold-working of the material has taken place at a temperature around the recrystallisation temperature of the alloy.

4. An exhaust valve according to claim 1, wherein after the cold-working, the yield strength of the alloy has been further increased by means of a precipitation-hardening heat treatment.

5. An exhaust valve according to claim 1, wherein the seat material has a yield strength of at least 1100 MPa.

6. An exhaust valve according to claim 1, wherein the seat material has a yield strength of at least 1200 MPa.

7. An exhaust valve according to claim 1, wherein the seat material has a yield strength of at least 1300 MPa.

8. An exhaust valve according to claim 1, wherein the seat material has a yield strength of at least 1400 MPa.

9. An exhaust valve according to claim 1, wherein the seat areas on the stationary member and the valve disc, respectively, have mainly the same yield strength at operating temperatures of the seat areas.

10. An exhaust valve according to claim 1, wherein the seat area on the valve disc has a substantially lower yield strength than the seat area on the stationary member at operating temperatures of the seat areas.

11. An exhaust valve according to claim 1, wherein said valve disc has an external diameter in the range from 130 mm to 500 mm.

12. An exhaust valve according to claim 11, wherein said exhaust valve is a two-stroke crosshead engine exhaust valve.

13. An exhaust valve for an internal combustion engine having a stationary valve member with a seat area, wherein the exhaust valve comprises a movable spindle with a valve disc having an upper surface with an annular seat area, said valve disk and seat area being of a nickel-based olloy having a recrystallisation temperature, and wherein at least said seat area has been manufactured by means of either casting or powder metallurgical application followed by thermo-mechanical deformation at a temperature lower than or around the recrystallisation temperature of the alloy and with a degree of deformation providing the seat area with dent mark preventing properties in the form of a yield strength ($R_{p02}$) of at least 1000 MPa at room temperature.

14. An exhaust valve according to claim 13, wherein the seat material has a yield strength of at least 1100 MPa.

15. An exhaust valve according to claim 13, wherein the seat material has a yield strength of at least 1200 MPa.

16. An exhaust valve according to claim 13, wherein the seat material has a yield strength of at least 1300 MPa.

17. An exhaust valve according to claim 13, wherein the seat material has a yield strength of at least 1400 MPa.

18. An exhaust valve according to claim 13, wherein said valve disc has an external diameter in the range from 130 mm to 500 mm.

19. An exhaust valve according to claim 18, wherein said exhaust valve is a two-stroke crosshead engine exhaust valve.

20. A new use for a nickel-based chromium-containing alloy as a dent mark limiting material in a valve disc seat area, wherein an exhaust valve for an internal combustion engine has a movable valve disc with an annular seat area, said valve disk and said seat area being provided with a nickel-based alloy having a yield strength of at least 1000 Mpa at room temperature.

* * * * *